US006930693B1

(12) United States Patent
Coker et al.

(10) Patent No.: US 6,930,693 B1
(45) Date of Patent: Aug. 16, 2005

(54) FAST READOUT OF MULTIPLE DIGITAL BIT PLANES FOR DISPLAY OF GREYSCALE IMAGES

(75) Inventors: Timothy M Coker, Peterborough (GB); William A Crossland, Cambridge (GB)

(73) Assignee: QinetiQ Limited, London (GB)

( * ) Notice: Subject to any disclaimer, the term of this patent is extended or adjusted under 35 U.S.C. 154(b) by 0 days.

(21) Appl. No.: 09/868,242

(22) PCT Filed: Dec. 16, 1999

(86) PCT No.: PCT/GB99/04277

§ 371 (c)(1),
(2), (4) Date: Jan. 10, 2002

(87) PCT Pub. No.: WO00/38168

PCT Pub. Date: Jun. 29, 2000

(30) Foreign Application Priority Data

Dec. 19, 1998 (GB) ..... 9827944

(51) Int. Cl.[7] ..... G09G 5/10
(52) U.S. Cl. ..... 345/690; 345/89; 345/692
(58) Field of Search ..... 345/89, 87, 88, 345/94, 99, 84, 77, 63, 600, 589, 690–692; 315/169.1–169.3; 382/232

(56) References Cited

U.S. PATENT DOCUMENTS 5,657,099 A * 8/1997 Doherty et al. ..... 348/743
5,737,038 A * 4/1998 Gale et al. ..... 348/759
5,986,640 A * 11/1999 Baldwin et al. ..... 345/596
6,320,986 B1 * 11/2001 Strohacker ..... 382/239
6,512,853 B2 * 1/2003 Kennedy et al. ..... 382/238
6,577,291 B2 * 6/2003 Hill et al. ..... 345/89

FOREIGN PATENT DOCUMENTS

| | | |
|---|---|---|
| EP | 0 762 375 | 3/1997 |
| EP | 0 774 745 | 5/1997 |
| EP | 0 884 717 | 12/1998 |

* cited by examiner

*Primary Examiner*—Regina Liang
*Assistant Examiner*—Jennifer T. Nguyen
(74) *Attorney, Agent, or Firm*—Nixon & Vanderhye P.C.

(57) ABSTRACT

In a method of signal processing for greyscale imaging in which weighted bitplanes corresponding to a greyscale image are stored as binary strings in sequential locations in a memory, in decreasing order of intended duration (weighting), a number of read passes equal to the number of weighted bitplanes are made from the set of stored bitplanes, each pass commencing with the highest order bitplanes and continuing along the stored bitplanes in sequence, the lengths of the sequences being varied and selected such that at the end of the said number of read passes each bit plane has been read out a plurality of times proportional to or equal to its duration (weighting). The method has utility in driving high speed liquid crystal matrix arrays particularly where each bitplane needs to be refreshed. A small ac potential may be applied to the array between writing steps.

7 Claims, No Drawings

FAST READOUT OF MULTIPLE DIGITAL BIT PLANES FOR DISPLAY OF GREYSCALE IMAGES

The present invention relates to a method of signal processing for multi-level, e.g. greyscale, imaging, and to using such a method for operating a display or spatial light modulator in which the instantaneous intensity distribution afforded by the display or modulator is binary in nature but which is altered in a manner such that the time averaged distribution effectively has, or appears to have, multiple intensity levels, e.g. of intensity. For display purposes, this means that the alteration must be sufficiently fast for averaging to occur at the eye, preferably avoiding any flicker. This requirement may or may not apply for other purposes.

The signal processing method of the invention can be used in conjunction with any spatial light modulator capable of producing a binary image, including those comprising an array of individually addressable cells or pixels, and those where the binary image is produced by scanning of a modulated light beam, for example. The term "binary spatial light modulator" used herein is intended to encompass all such devices, whether they are used for display or other purposes, for example information recordal, and variable components (for example lenses, filters and diffraction gratings) in optical systems. The term is intended to cover passive modulators where an existing light beam is affected by the modulator, and also those which act as light sources, for example arrays of light emitters, and electroluminescent devices.

The term "image" as used herein is used to denote any spatially varied light distribution, normally, but not necessarily, of light intensity, and its production or resulting distribution will be referred to by the term "display".

Furthermore, although the term "grey scale" is used herein as denoting a multi-level distribution, it should be made clear that the term is used in relation to any colour, including white. In addition, although the methods, arrays, backplanes, circuitry etc. of the invention and its embodiment are described in relation to a single colour (monochrome images), including white, it is envisaged that variable colour images or displays etc. be produced in manners known per se, such as by spatially subdividing a single array into different colour pixels, superimposing displays from differently coloured monochrome arrays for example by projection, or temporal multiplexing, for example sequential projection of red green and blue images.

Temporally varying binary modulation to achieve a multiple intensity effect is known, and can be effected by the use of multiple bit planes. In such a scheme, an array of digitised values, of amplitudes corresponding to the grey scale values allocated to the pixels of the array, is decomposed into a multiplicity of bit planes. This multiple bit plane technique may be used with any binary spatial light modulator as defined above.

It is possible to decompose a n-level digitised grey scale image into a plurality of image planes, or bit planes, e.g. binary planes (see below), of equal duration. However, in a preferred form, known as a weighted bit plane technique, the durations of the bit planes are weighted, each bit plane being representative of one level (exponent) of the digitisation. This reduces the number of bit planes which need to be stored to synthesise an image, and can reduce addressing requirements somewhat.

Although in certain cases, it would be possible to use digital bases other than 2, this complicates matters insofar as each bit plane is not binary and thus is not so easily stored.

Furthermore, each location of such a bit plane would then have more than one non-zero value, and the variation in non-zero values across the bit plane would need to be taken into account for the durations of operation of each pixel (possibly by further decomposing the non-binary bit plane to two or more binary bit planes). The discussion below will be limited to binary weighting, but the principles set out in such a context are believed to be sufficient to enable the skilled person to extrapolate to other exponential bases if required or desired.

Where the digitisation is binary, so that each bit plane is an array of digital 1s and 0s, it is then only necessary to display each bit plane for a total period proportional to its binary weighting to provide a time averaged image equivalent to the digitised grey scale image.

Where possible, it is convenient to display each binary bit plane once for the total duration necessary to contribute to the grey scale image, but it is also possible to display one or more of the bit planes a plurality of times, not necessarily sequentially, provided that the total time spent in displaying each bit plane, relative to the total time spent in displaying all the bit planes, is proportional to its binary weighting.

The different bit planes for a grey scale image can be stored as sequential binary strings in a computer, and will be read out one at a time in any desired order after which they can be discarded unless the image needs to be repeated. It is computationally easiest to read out the bit planes in the order in which they have been stored, since then the only address which needs to be stored is the starting address of the first stored bit planes, all bit planes then being read out one at a time simply by clocking out a predetermined number of data bits in sequence for each bit planes.

It might be possible immediately to replace bit planes that have been read by the bit planes for a succeeding image, particularly where the bit planes are being produced in real time. However, under other circumstances this could be difficult, and the set of bit planes for a successive image will then normally be stored elsewhere. In certain cases it would be possible to provide storage for just two bit planes one of which is written while the other is being read, and vice versa.

It would also be possible to control the reading and/or writing processes so as to convert the image standards as desired, for example from line sequential to interlaced.

As or after each bit plane is read from memory, it is then written, e.g. using the single pass scheme described below, and viewed over a period corresponding to its weighting so that the eye synthesises the intended grey scale image. The single pass scheme is preferred insofar as it merely overwrites the preceding bit plane without the need for a second pass, the associated front electrode switching and blanking pulses. The avoidance of lost time between successive valid images enables continuous illumination and the easier provision of bit planes of an accurately weighted duration.

In such a scheme, each pixel is subjected to a series of voltage pulses according to the point in the grey scale it represents (as in the number representing the grey scale level, and usually but not necessarily in that order). There are more points in the grey scale than there are applications of voltages, due to the weighting employed, which is advantageous since it reduces the time spent actually driving the array. Each applied voltage may be of the same or opposed polarity compared to the preceding voltage, and the same number of voltage pulses, equal to the number of bit planes (ignoring polarity), is applied to each pixel to synthesise the image.

For example, in a 64 level grey scale with binary weighting, there will be 6 bit planes with relative durations of $2^n$t where n ranges from 0 to 5, and each pixel can be represented by a corresponding 6 digit binary number.

However, double pass schemes below could alternatively be adapted for use in multiple or weighted bit plane schemes.

To achieve dc balance, it would be possible to produce each binary bit plane by any binary imaging method which itself produces dc balance—for example by starting from a blank image, writing, viewing and erasing the binary image by selective energisation (+V) and driven blanking (−V) of selected pixels only.

However, in most or all of such schemes, the actual duration of the binary image is not directly proportional to the time allocated thereto, for example because of intervening blanking steps, etc., leading to a degree of distortion in the binary nature of the bit plane periods, and hence the perceived grey scale values. While this could be compensated for if desired, it represents an additional complication.

Recently there has been developed a novel spatial light modulator in the form of a smectic liquid crystal layer disposed between an active semiconductor backplane and a common front electrode. It was developed in response to a requirement for a fast and, if possible, inexpensive, spatial light modulator comprising a relatively large number of pixels (320×240 up to 640×480) with potential application not only as a display device, but also for other forms of optical processing such as correlation and holographic switching. Depending on the manner in which it is driven, and the value of the applied voltage, the modulator may be driven at a line rate of at least 10 MHz and a frame rate of up to 15 to 20 kHz, requiring a data input of around 1 to 1.5 Gpixel per second. Typically, while the pixel address time is around 100 nanoseconds, the pixel will actually take around 1 to 5 microseconds to switch between optical states;

and while overall frame writing time is of the order of 24 microseconds, the frame to frame writing period is around 80 microseconds.

This spatial light modulator can be driven according to single pass schemes, in which the front electrode is placed at a potential of V/2 relative to the backplane pixels, which are switched to zero volts or V volts.

Alternatively it can be driven according to double pass schemes in which in one pass the front electrode is placed at zero volts and selected pixels are turned ON by switching pixel elements of the backplane array to V volts, and in the other pass the front electrode is placed at V volts and selected pixels are turned OFF by switching elements of the array to zero volts. For pixels which are not in the process of being switched the elements of the backplane follow the voltage of the front electrode. To maintain the same potential difference therebetween, the voltage at all backplane pixel elements of the array is simultaneously switched as the voltage on the front electrode is changed between zero and V volts.

Our copending International Patent Applications (PCT/GB99/04285, ref: P20957WO, priority GB9827952.4; PCT/GB99/04286 and PCT/GB99/04276, refs: P20958WO and P20958WO1, both priority GB9827965.6; PCT/GB99/04282, ref: P20959WO, priority GB9827900.3; PCT/GB99/04279, ref: P20960WO, priority GB9827901.1; PCT/GB99104274, ref: P20961WO, priority GB9827964.9; PCT/GB99/04275, ref: P20962WO, priority GB9827945.8; and PCT/GB99/04260, ref: P20963WO, priority GB 9827944.1) relate to other inventive aspects associated with this spatial light modulator, including the single and double pass schemes referred to in the preceding paragraph.

The aforesaid spatial light modulator is ideally suited to the use of the bit plane technique mentioned above. However, the present invention is not limited to liquid crystal modulators, but can be applied to any spatial light modulator as referred to above.

One problem which arises, particularly when operating liquid crystal display and modulators, is that of maintaining a dc balance at individual pixels. Our copending International Patent Application (PCT/GB99/04260, ref: P20963WO) filed together with this application is directed to a weighted bit plane technique as described above in which at least some of the bit planes are modified, and relates to a method of grey scale imaging using a weighted bit plane technique, in which an n-digit binary number represents the intended grey level of each pixel location in an array of binary pixels, wherein at least one said binary number has an unequal number of 1s and 0s, said method comprising the step of altering the number to a closely adjacent value such as to reduce the inequality of 1s and 0s. That method has particular but not exclusive relevance to the production of effective grey scale intensity distributions for display purposes, where the effective duration of the binary images (length and/or number of repeats) is such that temporal integration thereof, for example by a viewer, gives the grey scale image. It finds particular but not exclusive application to liquid crystal spatial light modulators, and enables dc balance to be obtained or at least more closely approximated at each pixel.

The weighted bit plane method as operated therein requires that relaxation of the liquid crystal pixels is negligible over the duration of the longest bit plane, and this is not always possible. In such a case, the bit planes can be refreshed during the bit plane period(s), but at the expense of dc balance.

Basically, a refresh step comprises repeating the application of the same voltage as was applied at the start of the bit plane so as to restore the switched state of the pixel. It may even be that the nth power binary weighted bit plane needs to be refreshed $(2^n-1)$ times subsequent to the first writing so that a $2^n$ greyscale will involve $2^n$ frame writes of binary images when the refresh writing stages are included.

In a refresh scheme, bit planes are read out more than once, depending on the duration thereof. Thus it is not possible to discard the bit plane until it has undergone its final reading. Furthermore, if each bit plane is repeatedly read for the requisite number of times before proceeding to the next bit plane, it is necessary to store the starting address of the two bit planes.

For example, taking a simple case of three bit planes A, B and C, of relative durations 4t, 2t and t respectively, it would be possible to read these out in the order AAAABBC. However, this necessitates storing the start addresses of each of the bit planes, apart from plane C which is read only once, in order that the correct place for the refresh readout may be reached.

European Patent Application 0762375 illustrates a method where bit planes are repeated a plurality of times according to their weighting, but the occurrences of the higher weighted bit planes are distributed throughout the display (frame) period. The bitplane sequence is not such that a lower weighted bit plane is always preceded by the next higher weighted bit plane, as will occur in the present invention to be explained below.

In addition, and perhaps more importantly, there are cases where it is necessary to rewrite the entire grey scale image before proceeding to a new image, where display times are long or relaxation is fast for example. In such a case it is necessary not only to store the start address of the bit plane next to be used, but also the start address of the first bit plane of the entire sequence, until that image information is no longer required.

An improved method of readout in such cases makes it possible to avoid the storage of a plurality of start addresses. At the high speeds involved in reading out the images when using the spatial light modulator of the preferred embodiment, this apparently minor step can be computationally significant and advantageous.

The present invention provides a method of image signal processing wherein a signal defining a pixellated multi-level image is defined by a first plurality of binary strings in a memory, strings having associated therewith respective weightings and defining respective bit planes each corresponding to a digitised pixelwise intensity distribution, such that the weighted pixelwise intensity distribution over all said plurality of bit planes corresponds to said multi-level image, the method being characterised in that at least a second plurality of said binary strings associated with the highest weightings are stored in sequential locations in said memory in decreasing order of weighting and the method including the step of making a succession of read cycles from the stored strings, each read cycle consisting of reading one or more of the stored strings in sequence as stored, commencing with the string for the highest weighting, the numbers of the strings read in the read cycles being varied so that at the end of the said succession of read cycles each string of the second plurality has been read out a number of times proportional to its associated weighting.

Preferably the multi-level image is a multi-intensity image.

The said succession of read cycles is repeated, for example where display times are long or relaxation is fast as noted above.

In one form of the method according to the invention all of the first plurality of strings are stored in sequential locations in said memory in decreasing order of weighting. In this case the succession of read cycles can be such that each string of the first plurality is read out a number of times proportional to its weighting.

The invention extends to a method of imaging in which the method of signal processing according to the invention is performed and each string of the first plurality is displayed as its bit plane each time it is read during the succession of read cycles for substantially the same period.

In another form of the method of signal processing according to the invention there is at least one said string with lower weighting, in addition to said second plurality, which is read out once during said succession of read cycles. In this case the invention also extends to a method of imaging by performing such a method of signal process wherein each string of the first plurality is displayed as its bit plane each time it is read during the succession of read cycles for substantially the same period, wherein when it is read said at least one said string with lower weighting is displayed as its bit plane for a duration which is less than said period and proportional to its weighting relative to the weighting of the lowest order string of the second plurality.

In a preferred imaging method the bit planes are displayed on a pixellated liquid crystal display. A small ac potential difference may of signal processing applied to pixels of the liquid display in periods when bit planes are not being written.

Thus the present invention requires that the second plurality of the bit planes, or all the bit planes, are stored as binary strings in sequential locations in a memory in decreasing order of weighting. By cyclically reading out from the stored bitplanes in sequence, starting with the highest weighted plane but varying the number of planes actually read out in each cycle, each bit plane can be read out a plurality of times proportional to or equal to its weighting. Where there are lower weighted planes in addition to the second plurality, these will be read out once, for duration(s) less than the lowest order bit plane of the first plurality. This can be done at any time, including a period or periods within the reading out of the second plurality, but is preferably performed before or after the entire second plurality has been read.

Thus in a method according to the present invention the triple bit plane image exemplified above will be read out with read passes ABC (once), AB (once), and A (twice), which when combined can give an overall order, for example, of ABCABAA, or ABCAAAB or ABAAABC as desired. Only the start address needs to be stored since each read pass commences at the same place, and continues to an address determined by counters.

While some grey scale and refresh schemes automatically provide dc balance, a further option for schemes which do not do this is to allow dc imbalance to accumulate, for example while writing images and then allowing them to relax, calculating the imbalance (e.g. in an accompanying computer simulation), and then applying local dc voltages to the pixels of a magnitude and duration such as to provide zero average dc.

It should be understood that there have been references above to a liquid crystal cell incorporating an addressable array, the methods of the invention may be used in relation to any binary spatial light modulator. Where the imaging device is a liquid crystal device, prolongation of the binary images used to synthesise the grey scale image may be achieved in known manner by the application of a small ac field between successive binary images.

What is claimed is:

1. A method of image signal processing wherein a signal defining a pixellated multi-level image is defined by a first plurality of binary strings in a memory, the strings having associated therewith respective weightings and defining respective bit planes each bit plane corresponding to a digitised pixelwise intensity distribution, such that the weighted pixelwise intensity distribution over all said plurality of bit planes corresponds to said multi-level image, comprising the steps of:

storing said strings in sequential locations in said memory in decreasing order of weighting; and making a succession of read cycles from the stored strings, each read cycle consisting of reading at least one of the stored strings in sequence as stored, commencing with the string for the highest weighting, the numbers of the strings read in the read cycles being varied so that at the end of the succession of read cycles each string has been read out a number of times proportional to its associated weighting.

2. A method according to claim 1 wherein the multi-level image is a multi-intensity image.

3. A method according to claim 1 or claim 2 wherein the said succession of read cycles is repeated.

4. A method of imaging comprising the steps of performing the method according to claim 1 and displaying each string as a bit plane each time each string is read during the succession of read cycles for substantially the same period.

5. A method of imaging according to claim 4 wherein the bit planes are displayed on a pixellated liquid crystal display.

6. A method according to claim 5 wherein a small ac potential difference is applied to pixels of the display in periods when bit planes are not being written.

7. A method of displaying an image on a pixellated display using a weighted bit plane technique, the method involving the steps of:

(i) defining a plurality of binary strings, each binary string representing a weighted bit plane for display and having a number of read out times associated therewith, the number of read out times proportional to the weighting of the bit plane, (ii) storing said binary strings in a display memory in sequential order of decreasing weighting of bit plane, and (iii) repeatedly reading out the binary strings in a plurality of read out cycles, each cycle starting with the binary string according to the highest weighting bit plane and reading out each sequential stored binary string which has not yet been read out the appropriate number of read out times.

* * * * *